US005411002A

United States Patent [19]

Smitley

[11] Patent Number: 5,411,002

[45] Date of Patent: May 2, 1995

[54] INTERNAL COMBUSTION ENGINE FUEL INJECTION APPARATUS AND SYSTEM

[75] Inventor: Marion L. Smitley, Birmingham, Mich.

[73] Assignee: Walter Potoroka, Sr., Oakland, Mich.

[21] Appl. No.: 662,568

[22] Filed: Feb. 28, 1991

[51] Int. Cl.[6] ..... F02M 37/04

[52] U.S. Cl. ..... 123/497; 123/357

[58] Field of Search ..... 123/497, 499, 357, 358, 123/359, 494

[56] References Cited

U.S. PATENT DOCUMENTS

| | | | |
|---|---|---|---|
| 3,699,931 | 10/1972 | Cinquegrani | 123/497 |
| 3,822,677 | 7/1974 | Reddy | 123/497 |
| 3,935,851 | 2/1976 | Wright | 123/497 |
| 3,967,598 | 7/1976 | Rachel | 123/447 |
| 4,205,648 | 6/1980 | Graham | 123/497 |
| 4,359,984 | 11/1982 | Nakao | 123/497 |
| 4,756,291 | 7/1988 | Cummins | 123/497 |
| 4,800,859 | 1/1989 | Sagisaka | 123/497 |
| 4,919,102 | 4/1990 | Iwabuchi | 123/497 |
| 4,920,942 | 5/1990 | Fujimori | 123/497 |
| 4,926,829 | 5/1990 | Tuckey | 123/497 |

*Primary Examiner*—Carl S. Miller
*Attorney, Agent, or Firm*—Walter Potoroka, Sr.

[57] ABSTRACT

An engine fuel injection system is provided, wherein pumping maximum possible fuel required by the engine and by-passing excess fuel not used by the engine are eliminated, the speed of the variable speed electric fuel pump for the system being controlled so as to pump only the quantity of fuel required to operate the engine under certain sensed engine and/or ambient operating conditions, such control being provided by a fuel pressure sensor/electronic pump motor speed control.

7 Claims, 1 Drawing Sheet

INTERNAL COMBUSTION ENGINE FUEL INJECTION APPARATUS AND SYSTEM

FIELD OF INVENTION

This invention relates generally to engine fuel injection systems, and more particularly to an electronic fuel injection system and apparatus for supplying gasoline fuel to an associated internal combustion engine.

BACKGROUND OF THE INVENTION

The cars, trucks and other vehicles driven by gasoline fuel internal combustion engines today are designed with an on-board computer to electronically control the various systems and devices contained in these vehicles.

As is well-known in the art, the basic components of a typical prior art electronically-controlled fuel metering system in such vehicles are generally as follows:

1. a fuel tank;
2. an electric fuel pump, often mounted in the fuel tank;
3. a pressure regulator for maintaining the pressure of the fuel supplied by the pump at a required constant pressure;
4. sensors appropriately mounted on the engine or vehicle, each producing an electrical signal representative of the various conditions under which the engine must operate, in accordance with which the quantity of fuel supplied to the engine is to be controlled;
5. a solenoid-operated or other suitable electrically-controlled fuel injector(s) for supplying a metered quantity of pressure-regulated fuel to the engine fuel induction system or to the individual engine cylinders;
6. an electronic control unit for receiving, as inputs thereto, the electric signals generated by the sensors and producing, as the output therefrom, a single integrated electrical signal for controlling the injector(s);
7. a direct current electrical power source, such as a battery and/or an alternator;
8. appropriate electrical switches and conductors (electrical circuit) connecting the electrical/electronic components (electrical circuit) of the system; and
9. appropriate fuel conduits connecting the fuel components (hydraulic circuit) of the system.

The fuel pump component of current state of the art systems is typically a positive displacement electric pump activated by turning the vehicle ignition switch to the ON position and designed to constantly supply the maximum quantity of fuel that will be required by the engine under the most severe conditions of speed, load, low ambient temperatures, etc., with all other power-demanding systems (air conditioning, heater, radio, lights, windshield wipers, etc.) operating.

However, since much more than 50% (possibly as much as 90%) of normal vehicle operation requires only a very small portion (possibly about 20%) of the above-mentioned constant, total, maximum-required fuel pump output, it is necessary to by-pass the excess fuel (pumped to 30–40 psi) not required by the engine during most normal operating conditions back to the fuel tank or to sump pressure, through a by-pass conduit that normally carries a much greater volume of fuel than the conduit carrying fuel to be consumed in the engine cylinders. Obviously, total pumped fuel equals consumed fuel plus by-passed fuel.

Such fuel by-pass systems, especially where the by-passed fuel greatly exceeds the consumed fuel, creates and experiences serious inherent problems, such as the following, for example:

a. Substantial energy (gasoline to provide the required power) is being wasted pumping fuel, to approximately 30–40 psi, and consuming very little (about 20%) of the total pumped fuel.
b. Vapor is being churned out of the fuel, which also requires energy and reduces fuel economy.
c. Pumping any fluid to high pressure creates heat that must be dissipated somehow. This is specially true in gasoline engines where the injectors are designed to and must meter liquid fuel, rather than fuel vapors. It is understood that various automotive vehicle manufacturers and others are going to the expense of trying to develop ways to dissipate this heat to cure well known vapor and other hot fuel handling problems.

SUMMARY OF THE INVENTION

Prior to present day electronic fuel metering, an engine-driven diaphragm fuel pump was used to supply fuel to the fuel bowl(s) of a carburetor, and the pump supplied only the amount of fuel required (being consumed) by the engine. This pump was unique, in that it was truly a variable displacement pump which pumped fuel only on demand, and the fuel system did not require a fuel by-pass conduit back to sump pressure or the fuel tank.

However, the above diaphragm pump became impractical and obsolete with the advent of electronic fuel metering systems, since the fuel pressure requirement was increased from about 4–6 psi to about 30–40 psi. That is, present day electric fuel pumps are constant-speed, positive displacement pumps supplying a constant quantity of fuel at 30–40 psi that, of necessity, must be the maximum quantity of fuel that the engine will ever consume under the most extreme power requirement conditions, all fuel not consumed in the engine being by-passed to sump or tank, resulting in the above-mentioned problems.

Accordingly, a main object of the invention is to provide an electronic fuel metering system that eliminates the pumping and by-passing of fuel in excess of the quantity of fuel required for consumption in the engine, under all engine/ambient operating conditions.

Another object of the invention is to provide such a system having means whereby the d.c. pump motor speed is varied to limit the quantity of fuel supplied by such d.c. motor-driven fuel pump to that quantity required by the engine, at the required fuel pressure.

Still another object of the invention is to provide means of supplying fuel pressure to the electronic fuel metering system which eliminates the pumping and by-passing of fuel in excess of the quantity of fuel required for consumption in the engine.

A further object of the invention is to provide such a system having means whereby pump motor speed is controlled, in accordance with sensed system fuel pressure, so that the fuel pump will discharge only that quantity of fuel sufficient to maintain the correct operating fuel pressure required by the electronic fuel metering system.

Another object of the invention is to provide such a system that is free of a fuel pressure regulator/excess pressure by-pass means and in which fuel pressure sensor means develops an electric signal representative of instantaneous system fuel pressure and feeds that electric signal, as an input to an electronic controller means for the fuel pump motor, to control fuel pump motor speed in a manner so that the fuel pump will discharge only the quantity of fuel required to maintain the correct fuel metering system pressure.

Another object of the invention is to provide such a system, wherein proper fuel metering is dependent upon maintenance of a constant required system fuel pressure, but wherein such constant required system fuel pressure is maintained not by by-passing excess fuel but by controlling fuel pump motor speed to maintain the required system fuel pressure.

An even further object of the invention is to provide such a system that is free of any means for pumping and by-passing fuel in excess of that quantity of fuel required for consumption in the engine under any sensed ambient or engine operating parameter.

A still further object of the invention is to provide such a system, wherein adaptation thereof to current excess fuel by-pass systems requires a minimum modification of such current excess fuel by-pass systems.

A still further object of the invention is to provide aftermarket kit method and means for adapting or modifying a current excess fuel by-pass system to a system embodying the invention, wherein excess fuel is not pumped and by-passed, thereby reducing or eliminating the above-mentioned problems of by-pass systems.

Still another object of the invention is to easily provide such a system with minimum modification to existing by-pass systems.

The above, and various other general and specific objects, advantages and aspects of the invention will become apparent when reference is made to the following detailed description considered in conjunction with the accompanying drawings.

BRIEF DESCRIPTION OF THE DRAWING

The drawing is a block diagram of an electronic fuel metering system embodying the invention, wherein certain details and/or elements not shown are considered to be matters already known in the prior art or which can be supplied by the application of ordinary skill in the electronics art, as exemplified in the prior art patents referred to herein below.

DETAILED DESCRIPTION OF THE INVENTION

Figure 1:
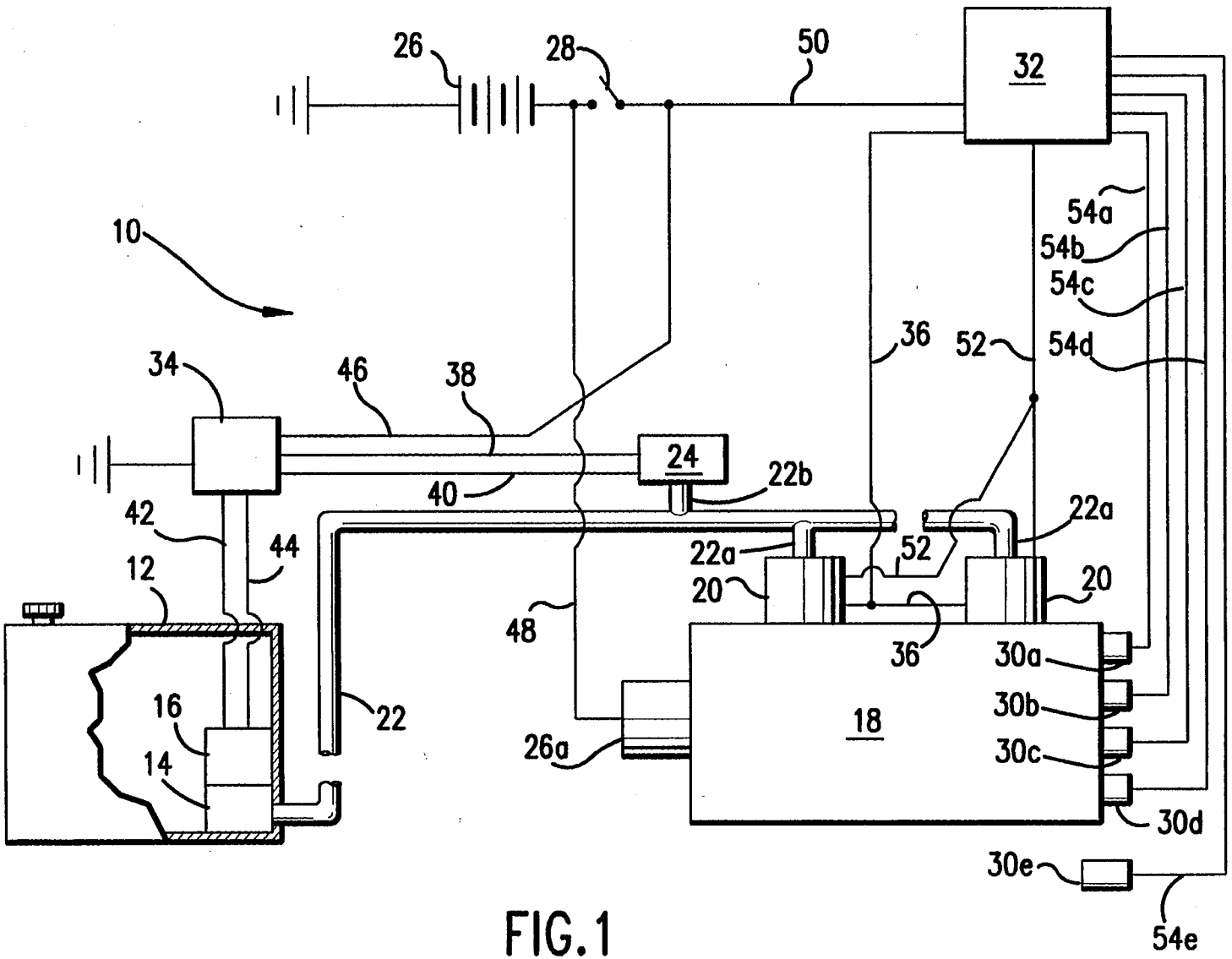

The invention is possibly best described by initially referring to typical prior art electronic fuel injection systems in which an electric fuel pump continuously supplies unmetered fuel (total pumped fuel) at a rate at least equal to the maximum possible fuel that could be consumed in engine operation under the most fuel-demanding ambient and engine operation conditions, as already referred to above. At any given instant, a metered quantity of fuel (referred to as "consumed" fuel) is supplied to the engine and an unmetered quantity of fuel (referred to as "by-passed" fuel) is returned to the fuel tank or to the inlet side (sump) of the fuel pump.

For example, U.S. Pat. No. 4,292,945 teaches an electronic fuel metering apparatus and system in which electric fuel pump means 32 supplies unmetered fuel (total pumped fuel) from tank 30 to the electrically-operated fuel metering valve 104, which is controlled by the fuel demand output signal 116/118 generated by electronic control means unit 122, in response to a plurality of input sensor signals (134, 156, 126, 152, 150, 138 and 140) to supply a proper quantity of metered fuel (consumed fuel) to the engine through metered fuel conduit 70, the pumped fuel pressure being maintained at the required pressure by pressure regulator 42, with the excess fuel (by-passed fuel) being returned to the tank through return fuel conduit 66.

As already stated above, such a system continuously by-passes most of the total pumped fuel, which equals the consumed fuel plus the by-passed fuel.

In the system taught in U.S. Pat. No. 4,590,911, total pumped fuel at a pressure regulated by pressure regulator 86 is supplied from tank 70 by pump 74 to electronic fuel metering valve 66 controlled by control means 240, the metered fuel (consumed fuel) being supplied to the engine through conduit 60 and the excess fuel (by-passed fuel) being returned to the pump 74 through the unnumbered fuel conduit extending between regulator 86 and pump 74.

In the system taught in U.S. Pat. No. 4,787,418, which is generally similar to the two prior art systems discussed immediately above, conduit 14 carries the unmetered fuel (total pumped fuel) supply from pump 72 and tank 16, while conduit 76 carries the excess fuel (by-passed fuel) back to tank 16.

It is readily apparent that all three prior art systems referred to above are fuel by-pass systems having a fuel pressure regulator controlling the by-pass, and subject to the disadvantages of such systems discussed under the heading above entitled "Background of the Invention".

The by-pass fuel system taught by U.S. Pat. No. 3,604,401 comprises a fuel injector, in combination with a pickup tube that carries unused (excess) pumped fuel back to the fuel tank.

While U.S. Pat. No. 4,532,893 relates to an electronically controlled fuel pump, as stated in the Abstract, it is an auxiliary pump that supplies fuel flow to cool a microprocessor during conditions such as engine shutdown, which is an entirely different function having nothing whatever to do with supplying the fuel consumed in the engine.

Finally, U.S. Pat. No, 4,109,669 involves "return flow of fuel to the reservoir", U.S. Pat. No. 4,265,200 includes a pressure relief drain line 25 controlled by a valve slide 27 and U.S. Pat. No. 4,108,115 includes an "excess fuel control".

Some of the referenced prior art patents concern compression ignition, diesel fuel engines, which operate at much higher fuel pressures and with a much less volatile fuel, so that the disadvantages of fuel by-pass experienced in the lower pressure and more volatile fuel gasoline engines do not occur.

It is believed that all current production gasoline powered cars and trucks with electronic fuel metering systems have such by-pass systems, whatever the other structural details thereof might be, and experience the above-mentioned problems.

With the above background, and referring now to the appended drawing, it will be seen that an electronic fuel injection system 10 contemplated by the invention comprises a fuel tank 12, a fuel pump 14 driven by an electric motor 16, the pump being commonly, but not necessarily, mounted in the fuel tank 12, the associated internal combustion engine 18 having one or more electronically-controlled fuel metering valves 20 (commonly called fuel injectors) and an unmetered fuel conduit(s)

22 extending between the pump 14 and the injector(s) 20 having a fuel pressure sensor 24 adopted to generate an electrical signal representative of the instantaneous pressure of the fuel supplied by the pump 14.

The above described structure essentially comprises what is commonly referred to as the hydraulic (fuel) circuit of prior art systems, and the injectors 20 may be any one of several specific designs now well known in the art. As in prior art systems, the pump 14/16 contemplated by the invention is a positive displacement pump driven by a direct current variable-speed electric motor, of any suitable design and employed with circuitry such that pump fuel quantity discharge is proportioned to pump speed, which, in turn, is proportional to applied voltage, in accordance, for example, with the well-known speed equation $$\text{r.p.m.} = \frac{Ea - IaRa}{K\phi},$$

where r.p.m. is the motor speed in revolutions per minute, Ea is the voltage applied at the motor terminals; IaRa is the armature-resistance drop and $\emptyset$ is the flux per pole of the motor.

As stated below, it is understood that the invention is not limited to use of any particular injector and/or pump/motor design, which are well known in the art, any designs that will provide the objects of the invention being contemplated.

The electrical/electronic circuit of a fuel injection system 10 embodying the invention may comprise the usual direct current source, a battery 26 and alternator 26*a*, an ignition switch 28, a plurality of sensors 30*a–e*, each sensor being adapted to sense the instantaneous value of a separate ambient or engine operating condition in accordance with which consumed fuel is to be supplied to the engine 18 and to generate an electrical signal (preferably a voltage signal) representative of such value, the injector(s) 20 already referred to above, electronic computer means 32 adapted to receive the sensor signals as inputs thereto and to generate an instantaneous and continuous integrated variable electrical output signal for controlling the injector(s) or other suitable metering means 20 in a manner to provide exactly the proper required quantity of fuel for all sensed ambient and/or engine operating conditions.

For example, and without limitation thereto, the invention contemplates use of a common injector structure that includes a so-called duty cycle, solenoid-operated (ON-OFF) valve that varies the quantity of fuel supplied to the engine, in accordance with the time that the valve is open, the fuel being at a predetermined constant pressure, as determined by the fuel pressure regulator, or any injection system using a supply of fuel from a constant pressure source.

Power to operate the system 10 is provided by the battery 26/alternator 26*a*, in the well-known manner, whenever the ignition switch 28 is turned ON to activate the engine 18.

As thus far described, the system 10 is similar to, if not exactly like, all current electronically fuel injected engines, the differences from prior art systems being further described below.

It will and should be noted that a system 10 embodying the invention has no pressure regulator and no fuel by-pass conduit such as those contained in prior art systems. Rather, the system 10 proposed herein replaces the fuel pressure regulator/by-pass conduit with a pumped fuel pressure sensor 24 adapted to continuously sense the unmetered pumped fuel pressure and provide a continuous electrical signal representative of such instantaneous pressure, as an input to the electronic control 34, which, in turn, provides an electrical output signal to positive displacement pump 14 (preferably in the form of a voltage applied to the direct current pump motor 16) that varies the speed of motor 16 so as to maintain the pumped fuel pressure required by the system injector(s) 20 to meter exactly the correct instantaneous quantity of fuel required by the engine under the then existing ambient and engine operation conditions, as sensed by the sensors 30*a–e* and/or any other condition sensors on which the operation of the system 10 is based.

The amount of fuel being used by the engine will vary, depending upon various conditions, which, in turn, tends to raise or lower the pressure in the fuel line supplied by the positive displacement pump. The pressure relief valve (pressure regulator) in today's by-pass systems compensate for that by by-passing more or less fuel back to the tank or the fuel pump inlet. The proposed invention or system, in contrast to the prior art, compensates for such varying flow by sensing such tendency to raise or lower fuel pressure by controlling pump motor speed so that the pump supplies only the amount of fuel required (used) by the engine.

In the event that some present or future fuel injection system(s) or developments require variation of the pressure in the fuel supply line, the invention proposed herein has the capability of responding to such need, simply by programming the pressure source electronic control, such as control means 34, that controls the pump motor 16 to provide that function.

That is, with such pressure sensor control of pump speed, the pump discharges exactly and only the amount of fuel being used by the engine, in a manner similar to the prior art diaphragm pump/carburetor fuel systems referred to above, to eliminate the above-mentioned disadvantages of by-pass fuel systems. It is considered to be more practical and logical, and that the time has come, to eliminate the significant disadvantages of by-pass systems by eliminating the by-pass than it is to continue use of the by-pass systems and search for other means (which may introduce other problems) to overcome such disadvantages.

It has been stated recently in the news media, for example, that an increase of one mile per gallon in the fuel consumption of all U.S. motor vehicles would result in a reduction of millions of barrels of crude oil used per day, totalling several times the capacity of the tanker involved in the Alaska (Valdez) oil spill per day, which is significant and a worthy objective.

OPERATION OF THE INVENTION

When it is desired to activate the engine 18 and operate a vehicle driven by the engine, various ambient and/or engine conditions exist that are considered to be important to the determination of the quantity of fuel required by the engine, as described in some of the U.S. Patents referred to above.

When the ignition switch 28 is placed in the ON/engine crank position, and during subsequent engine operation, the system 10 is powered by the battery 26/alternator 26*a*, all sensors (30*a–e*, for example) are activated and the electrical signals therefrom are transmitted as inputs to the computer 32, which integrates such inputs and transmits an output fuel demand signal to the injector(s) 20.

Practice of the invention is not limited to, for example, a particular fuel metering means, of which there are many specific designs in current use, many of which, as described above, are of the duty-cycle type wherein a solenoid winding is intermittently energized to cause, during such energization, an armature metering valve member to move away from a valve seat, whereby the quantity of constant predetermined pressure metered fuel (consumed fuel) is determined by controlling the frequency and/or duration of solenoid energization.

The control means may comprise, for example, suitable electronic logic type control and power outlet means effective to receive one or more parameter-type input signals, and in response thereto, produce related outputs. For example, engine temperature responsive transducer (sensor) means may provide a signal via its transmission means indicative of engine temperature. Likewise, similar signals may be generated and transmitted by sensors for exhaust gas oxygen content, engine speed, engine load and other conditions such as those shown in FIG. 2 of U.S. Pat. No. 4,292,945.

As taught in U.S. Pat. No. 4,292,945 (col. 8, lines 8–25), certain fuel metering functions may be performed in an open loop manner, all of which are now well-known and in use in current production systems.

Of course, the fuel injection system contemplated by the invention also comprises the necessary fuel conduits and electrical conductors in the hydraulic and electrical/electronic circuits thereof.

In summary, and as shown in the drawing, an electronic automotive fuel system 10 embodying the invention may comprise a fuel tank 12, a positive displacement fuel pump 14 driven by a direct current electric motor 16, conduits 22, 22*a* and 22*b* transporting fuel to the injector(s) 20 and to the pressure sensor 24. The injector(s) 20 receive operating signals from the electronic control unit or computer 32 through lead or conductor 36, and the computer 32 integrates the electrical signal inputs generated by and received from the various sensors 30*a, b, c*, etc., on the engine 18 or in the surrounding engine area, all of which is as well-known in the art. The pressure sensor 24 transmits continuous instantaneous electric signals to the electronic control 34, such as through leads 38 and 40, which in turn sends the necessary signals, as in the form of a variable input voltage, through leads 42 and 44 to the fuel pump motor 16, which varies the speed of motor 16 to provide the correct required quantity and pressure of fuel in conduits 22 and 22*a* at all times of operation of the injection system 10.

It is obvious from the above descriptions that injectors 20 and fuel pump 14 are activated or controlled in response to different signals and operate independently of each other.

That is, the fuel injectors are designed to precisely meter the quantity of fuel required by the engine, provided that, in the case of some well known injectors, the fuel pressure supplied to the injectors is at a constant predetermined level. As stated above, in many prior art fuel systems, the proper fuel pressure is maintained by a pressure regulator, and the pump supplies more fuel than the engine can use, the excess fuel being by-passed back to tank by or at the pressure regulator.

The structure and function of ignition switch 28, the alternator (or a generator or other equivalent device) 26*a*, and conductors 46, 48, 50, 52 and 54*a–e* are well-known in the art.

As described herein, a system embodying the invention has no separate pressure regulator/excess fuel by-pass structure. Rather, as distinguished from the prior art, the pump motor 16 speed is varied by the pressure sensor 24/electronic control 34 (the pressure sensed by sensor 24 automatically includes the effect of the fuel flow restriction of the injectors 20, as controlled by the input thereto from the computer 32) so as to increase the quantity of fuel pumped, when the sensed fuel pressure decreases upon a reduction of the injector(s) restriction, to maintain the constant pressure required by the injector(s) for precise fuel metering.

The invention creates a market independent of original equipment, since it contemplates the aftermarket conversion, even by a reasonably knowledgeable do-it-yourselfer, of an original pressure regulator/fuel by-pass fuel injection system to a system embodying the invention, simply by proper removal of the usual pressure regulator/fuel by-pass structures and substitution of the pressure sensor 24/electronic control 34 elements, as taught herein. The conversion proposed herein is made possible, in part, by the fact that the invention described herein is adapted to use prior art original equipment, such as injectors, electric fuel pump and/or other fuel system hardware.

Such a proposed aftermarket conversion is similar to the already available conversion of a carburetor fuel system to an electronic fuel injection system, by purchase of a conversion kit manufactured and sold by a prominent independent aftermarket parts manufacturer. The fuel injection hardware is simply substituted for the carburetor system hardware, following printed instructions included in the kit.

Although only a preferred embodiment and selected modifications of the invention have been disclosed and described, it is apparent that other embodiments and modifications of the invention are possible with the scope of the appended claims, no other limitations being intended.

What I claim as my invention is:

1. A method of converting an existing by-pass type fuel injection system for an internal combustion engine having a fuel reservoir, wherein a d.c. variable speed electric motor-driven positive displacement fuel pump having an intake continuously supplies the maximum quantity of fuel that could be required under any engine/ambient operating condition and a fuel pressure regulator maintains the pumped fuel at a predetermined fuel pressure, the system including one or more sensors for sensing and producing electric signals representative of the instantaneous values of one or more selected engine/ambient parameters in accordance with which fuel is to be supplied to the engine, means for receiving said parameter signals and producing an integrated electrical signal representative of the instantaneous quantity of fuel required for engine operation, a fuel injector constructed and arranged to receive said integrated signal and supply fuel in accordance therewith to the engine at the regulated pressure, and an excess fuel by-pass conduit to return pumped fuel not required for engine operation to the fuel reservoir or the pump intake to a system wherein the fuel pump continuously supplies not the maximum quantity of fuel that could be required by the engine, but only the correct amount of fuel required instantaneously by the engine, thereby eliminating the disadvantages of pumping excess fuel, said method comprising the following steps:

a. removing the existing system fuel pressure regulator;
b. removing the existing excess fuel by-pass;
c. providing a system fuel pressure sensor for continuously providing an electrical signal representative of system fuel pressure;
d. varying the voltage applied to the d.c. pump motor so as to vary the speed of the motor, and thus the quantity of fuel pumped by the positive displacement pump, at the system fuel pressure.

2. An automotive-type electronic fuel injection system for a vehicle driven by a gasoline fuel internal combustion engine, said system comprising a fuel reservoir, a direct current electric motor-driven positive displacement fuel pump having intake and discharge openings, the speed of said motor being variable so that the quantity of fuel pumped by said pump is proportional to the speed of said motor, a source of direct current power, an internal combustion engine, at least one electronically-controlled fuel injector with inlet and discharge openings and having a metering restriction for supplying a correct quantity of fuel of a predetermined constant fuel pressure to said engine at all engine operating conditions in accordance with selected engine operating and/or ambient parameters, a fuel supply conduit connected between said fuel reservoir and said pump intake and between said fuel pump discharge opening and said injector inlet opening, a sensor for each of said engine operating and ambient parameters, each of said sensors providing an electrical output signal representative of the value of the sensed parameter at all times during operation of said engine and/or fuel system, an electronic control unit for receiving, as an input thereto, said sensor signal(Is) and processing the same to produce a single integrated electrical output signal to said fuel injector(s) for controlling said injector(s) to provide said correct quantity of fuel to said engine at a predetermined constant fuel pressure through said injector restriction, a fuel pressure sensor continuously sensing the pressure of the fuel supplied by said pump and creating an electrical signal representative of said sensed pressure, said sensed pressure reflecting the fuel flow condition of said injector, a fuel pump control unit constructed and arranged to receive said pressure sensor signal and to convert the same to an electrical voltage output signal for controlling the speed of said pump motor in a manner to produce the correct pump fuel discharge so as to supply the required fuel to said engine and electrical connections as required for operation of said system, said injector and said fuel pump being controlled in response to different signals so as to thereby operate independently of each other.

3. A fuel system for an internal combustion engine-driven vehicle, said system comprising a fuel reservoir, a positive displacement fuel pump driven by a variable speed electric motor and capable of supplying fuel in quantities dependent in part upon the speed of said motor, a fuel injector for supplying fuel to said engine, said fuel injector having a restriction operated by electrical means to vary the quantity of fuel supplied thereby, at a predetermined pressure and in accordance with an electrical signal thereto, a source of electrical energy, one or more sensors for sensing various engine operating and/or ambient condition(s), each of said sensor(s) continuously providing an electrical signal representative of the instantaneous value of one of said conditions, an electronic computer adapted to receive each of said sensor signals and integrating said signals to provide a single electrical signal output to said injector(s) to continuously supply a total quantity of fuel to said engine at said predetermined pressure and in accordance with the instantaneous value of each of said condition(s), a pressure sensor continuously sensing and providing an electrical signal representative of the instantaneous fuel pressure supplied by said pump and an electronic control device for receiving said instantaneous fuel pressure signal and providing an electrical output signal to adjust the speed of said pump motor to a speed that will cause said pump to pump sufficient fuel to result in a fuel pressure required for said injectors to provide the desired quantity of fuel to said engine, said injector and said fuel pump being controlled in response to different signals so as to thereby operate independently of each other.

4. A fuel system for an internal combustion engine, said system comprising a fuel tank, a variable speed positive displacement electric fuel pump, a fuel pressure sensor, a fuel injector for supplying fuel to said engine, means for controlling said injector to supply fuel at a predetermined pressure in quantities required by the engine, and separate means for controlling pump speed to supply constant pressure fuel required by the engine without pumping and by-passing excess fuel, said pump control means and said injector control means being independently activated so as to operate independently of each other, thereby eliminating problems such as wasted energy, fuel vapor and hot fuel handling problems caused by pumping maximum fuel and by-passing fuel in excess of the quantity being consumed in engine operation.

5. An internal combustion engine fuel system including a variable speed electric fuel pump and at least one fuel injector controlled by a signal integrated from a plurality of sensor-generated engine operating parameter signals for injecting the required fuel to the engine, means for elimination of problems associated with continuously pumping the maximum quantity of fuel that the engine could require and by-passing fuel not required by the engine, said means comprising a fuel pressure sensor for continuously sensing pumped fuel pressure and providing an electrical output signal representative of said pumped pressure and means receiving said signal as an input thereto and providing an output to said pump to control pump speed in a manner so that said pump will discharge only enough fuel to maintain the required system operating fuel pressure, said pump signal and said injector signal being different, so that said pump and said injector operate independently rather than operating in response to the same signal.

6. An engine fuel system, said system comprising an engine including at least one cylinder, a fuel reservoir, an electrically driven positive displacement fuel pump, an electrically driven fuel injector on said engine for metering the fuel supplied to said cylinder, a fuel conduit connecting said fuel reservoir, said fuel pump and said injector, said fuel system further comprising means for supplying a fuel at a specified constant pressure, said means being controlled by electrically changing the speed of said electrically-driven pump, sensor means generating engine operating signals for controlling said pump and said injector, said pump and said injector being controlled by different separate signals, whereby said pump and said injector operate independently of each other.

7. The method of claim 1, wherein said signal of step C is different and independent of said integrated signal to said injector.

* * * * *